US005950249A

United States Patent [19]

Clement

[11] Patent Number: 5,950,249

[45] Date of Patent: Sep. 14, 1999

[54] STEALTH CHEST GUARD

[75] Inventor: Theresa M. Clement, 61 Graham Ter., Saddle Brook, N.J. 07663

[73] Assignee: Theresa M. Clement, Saddle Brook, N.J.

[21] Appl. No.: 09/002,723

[22] Filed: Jan. 5, 1998

[51] Int. Cl.[6] ..... A41D 13/00

[52] U.S. Cl. ..... 2/463

[58] Field of Search ..... 2/455, 463, 464, 2/465

[56] References Cited

U.S. PATENT DOCUMENTS

| | | | |
|---|---|---|---|
| 4,317,237 | 3/1982 | Porte | 2/463 |
| 4,373,211 | 2/1983 | Goudreau | 2/463 |
| 5,245,706 | 9/1993 | Moschetti | 2/463 |
| 5,337,417 | 8/1994 | Whiteside et al. | 2/463 |
| 5,530,966 | 7/1996 | West | 2/463 |
| 5,621,914 | 4/1997 | Ramone et al. | 2/463 |
| 5,742,947 | 4/1998 | Davis | 2/463 |

*Primary Examiner*—Michael A. Neas

[57] ABSTRACT

The Stealth Chest Guard's size is 5"⅝" by 11"⅜" by ⅜" thick, it is comprised of a rubber pad to absorb the hit from an object such as a ball coming off of a bat or a bounce coming from the ground directed to the heart area. The plastic caplike shape that goes over the rubber is to help distribute the impact away from the heart area and give more support to the rubber pad. the soft terry cloth is worn for comfort and to let the skin breath. The flexablity of the rubber pad and the size of this chest guard was a very important factor. The players in the field need protection ,but they need flexability,and protection without the bulk that comes with other protective gear. The Stealth Chest Guard is light weight ,comfortable ,durable, and provides a protection for the players that is not yet available to them.

1 Claim, 7 Drawing Sheets

STEALTH CHEST GUARD

CROSS REFERENCES TO RELATED APPLICATIONS

This patent is based upon disclosure document number:424958. registered on Sep.12, 1997.

BACKGROUND

1. Field of Invention

This invention relates to chest protection, specifically to an improved chest protector, 2. Description of Prior Art In the past chest guards have played a very important role in the protection of the chest area. Umpires wear chest protection, catchers have chest protection,goalies have chest protection. But because of the size and bulk of these chest guards most players in the open field do not have any chest protection at all. For example let us use a baseball pitcher, here is a player that is subject to having a ball hit off a bat at top speed sometimes directly back to the pitcher. Another example is the batter when going to bunt stands facing the pitcher, who can pitch a fast ball directly down the middle and the batter has a chance of being hit in the chest. The designed for the chest guards in the past have been very big and bulky practical for a catcher but not practical at all for the majority of players who in the field need to be flexible, they need something light weight and something that will not get in the way of their throwing arm.

Presently a plurality of chest protectors are used. Examples of such protectors are U.S. Pat. No. 5,623,729. Mike C.Chen Apr. 29, 1997; This chest protector is to big for the player in the field,not possible for freedom of movement. Then there is U.S. Pat. No. 4,993,076, Edward G. Diericks, Feb. 19, 1991. This Protcetor covers most of the front of the body. Not practical for field players. U.S. Pat. No. 3,574, 861, Creighton J.Hale, Apr. 13, 1971; This protector is big and designed for catchers. Not fielders. U.S. Pat. No. 4,272, 847, William J. Buhler filed Apr. 30, 1979; was also designed for a catcher.

OBJECTS AND ADVANTAGES

Accordingly, several objects and advantages of my invention are Protection over the heart area, light weight, comfortable, easy to wear, flexible, not obtrusive. Still further objects and advantages will become apparent from a consideration of the ensuing description and accompanying drawings.

REFERENCE NUMERALS

SUMMARY

A chest guard comprising of a rubber pad, a piece of plastic, straps, snaps,and terry cloth material. The rubber pad is 11"⅜" long by 5"⅝" high by ⅜" thick. this rubber pad has a plastic caplike piece, smaller than the rubber 1/16" thick by 4" high by 5" wide. This plastic will be attached to the rubber by 3 rivets, one on the top of the plastic and two on the bottom part of the plastic to hold the plastic to the rubber. this will than be covered by terry cloth, to which a strap will attach and go around the players back to the other side of the pad, and one more strap will attach to the pad and go over the shoulder of the player wearing the chest guard. the straps will be adjustable to fit most any size.

PREFERRED EMBODIMENT—DESCRIPTION

Figure 2:
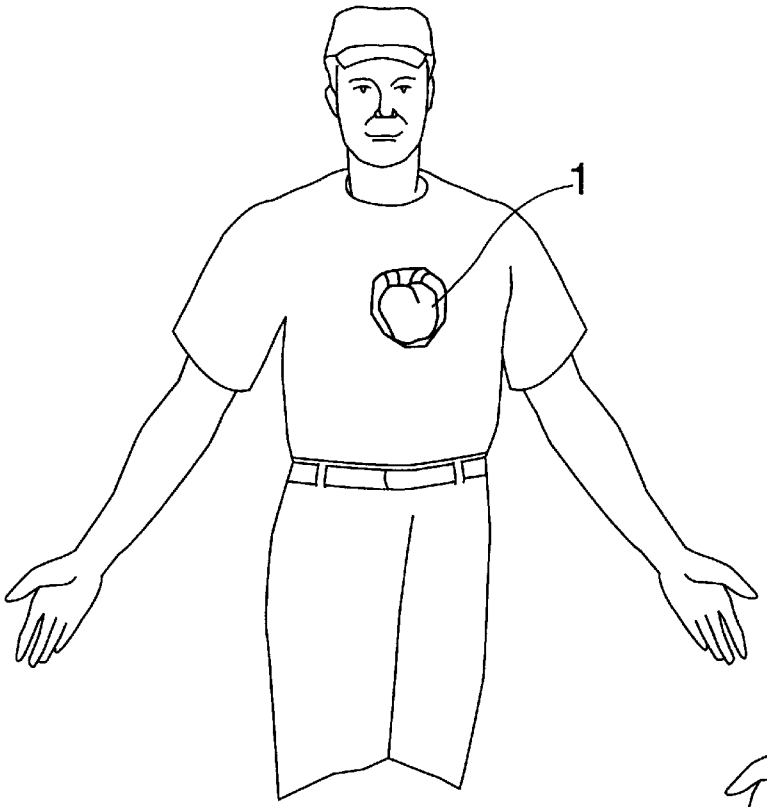
FIG. 2 shows the area over the heart.

FIG. 2. Item #1:Shows the chest area in which is the heart area.

Figure 1:
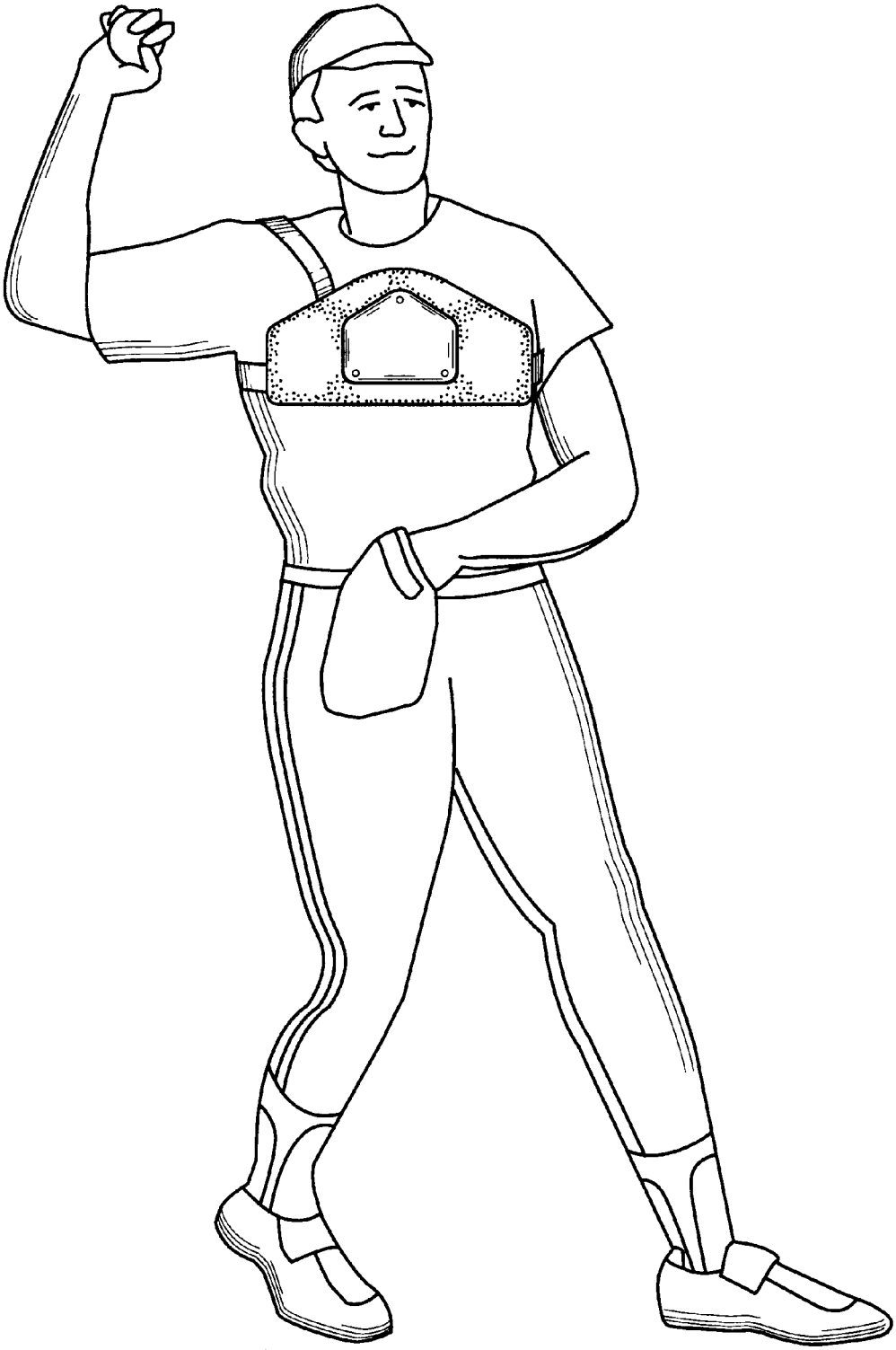
FIG. 1 shows how the chest guard is worn
Figure 3:
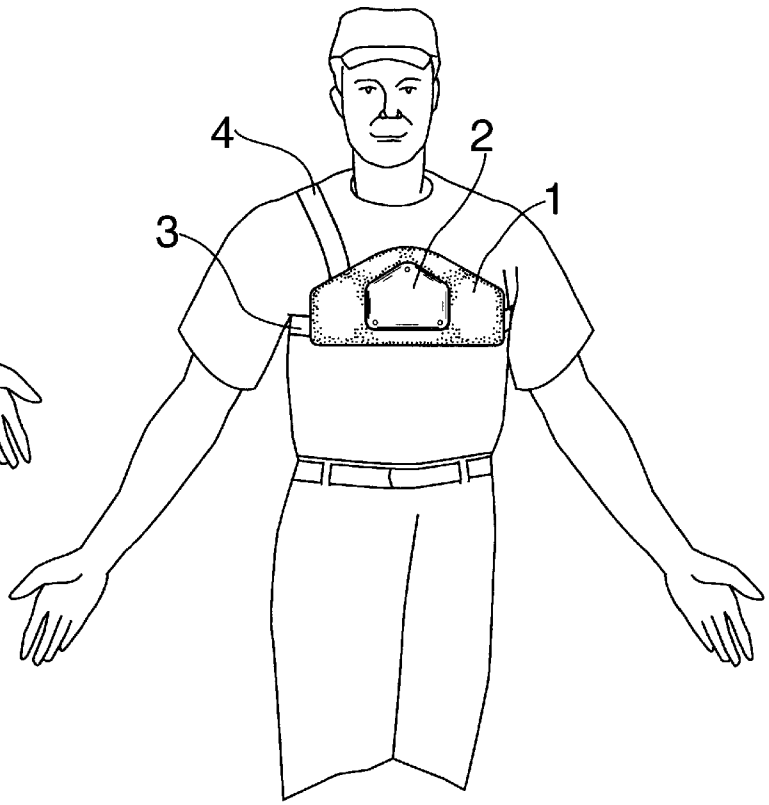
FIG. 3 shows the area protected by the chest guard

FIG. 3. Shows the Stealth Chest Guard covering the heart area.

FIG. 3. Item #1.:Rubber Pad ⅜" thick cushion;5"⅜" high by 11"⅜" long.

FIG. 3. Item #2.:Plastic Guard,which lays over the rubber pad,is 1/16" thick 4" high and 5" long.

FIG. 3. Item #3.:Adjustable strap, with snap, to go around the back of the player.

FIG. 3. Item #4.:Adustable strap, with snap to go over shoulder.

Figure 4:
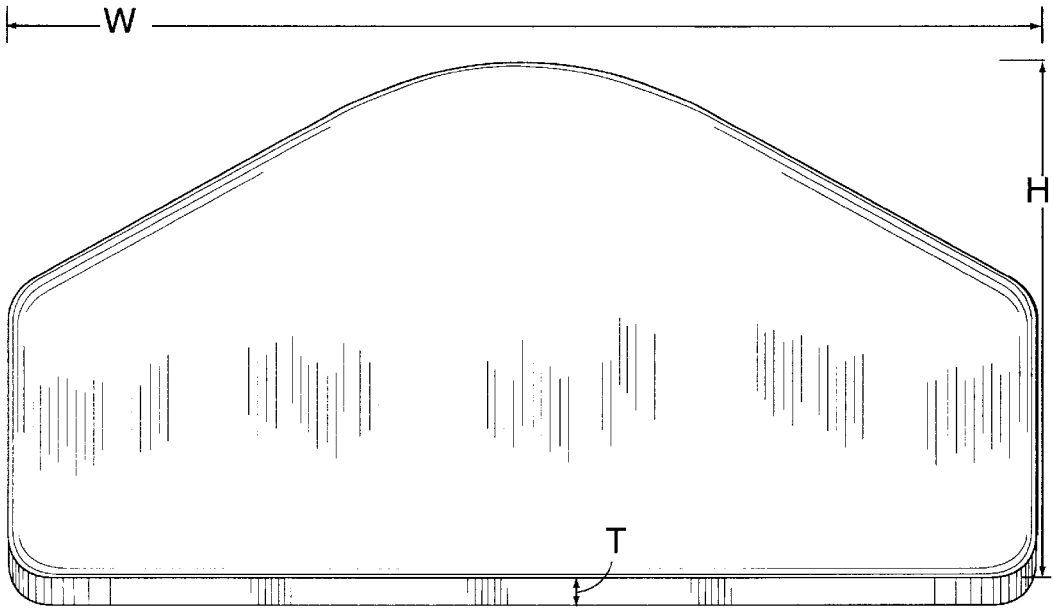
FIG. 4 shows the measurement of the rubber pad.

FIG. 4. rubber pad showing measurement.Which H=height:W=width:T=Thickness. H=5⅝":W=11⅜":T=⅜"

Figure 5:
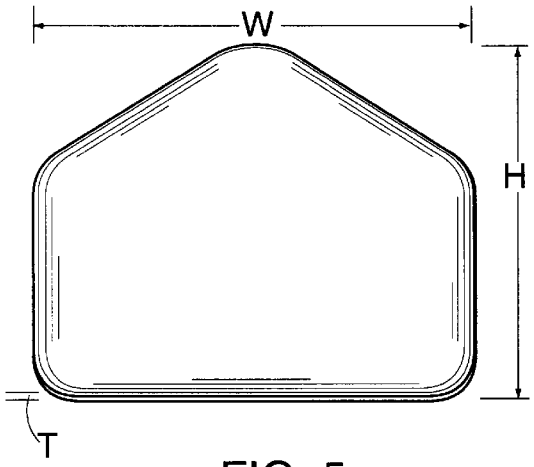
FIG. 5 shows the measurement of the plastic cap

FIG. 5. plastic cap showing measurement.Which H=height:W=width:T=Thickness. H=4":W=5":T=1/16".

Figure 6:
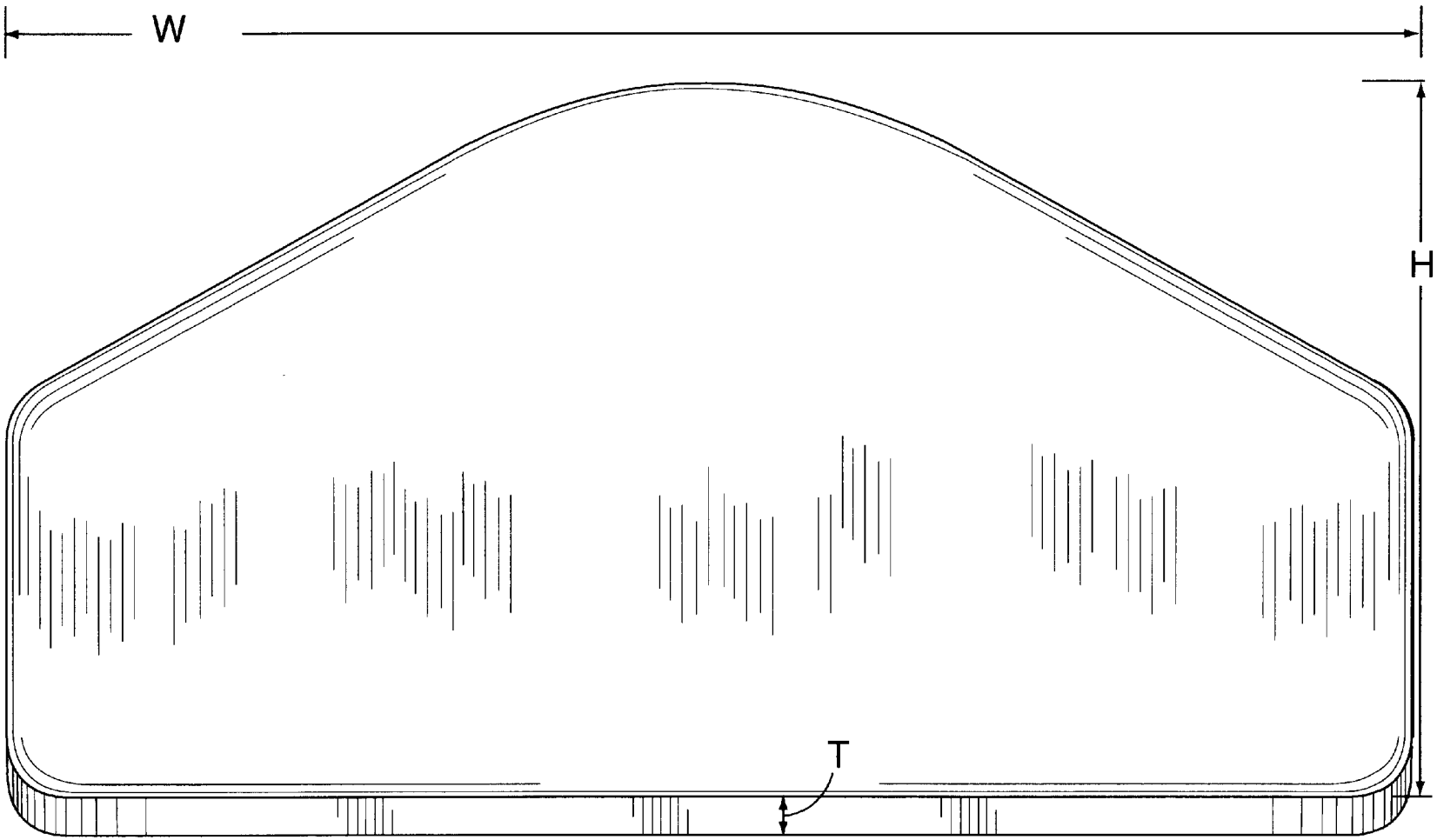
FIG. 6 shows the size of the rubber pad

FIG. 6. Size of rubber pad measuring:Which H=height: W=wide: T=thickness. H=5⅝": W=11"⅜ wide: T=⅜" thick.

Figure 7:
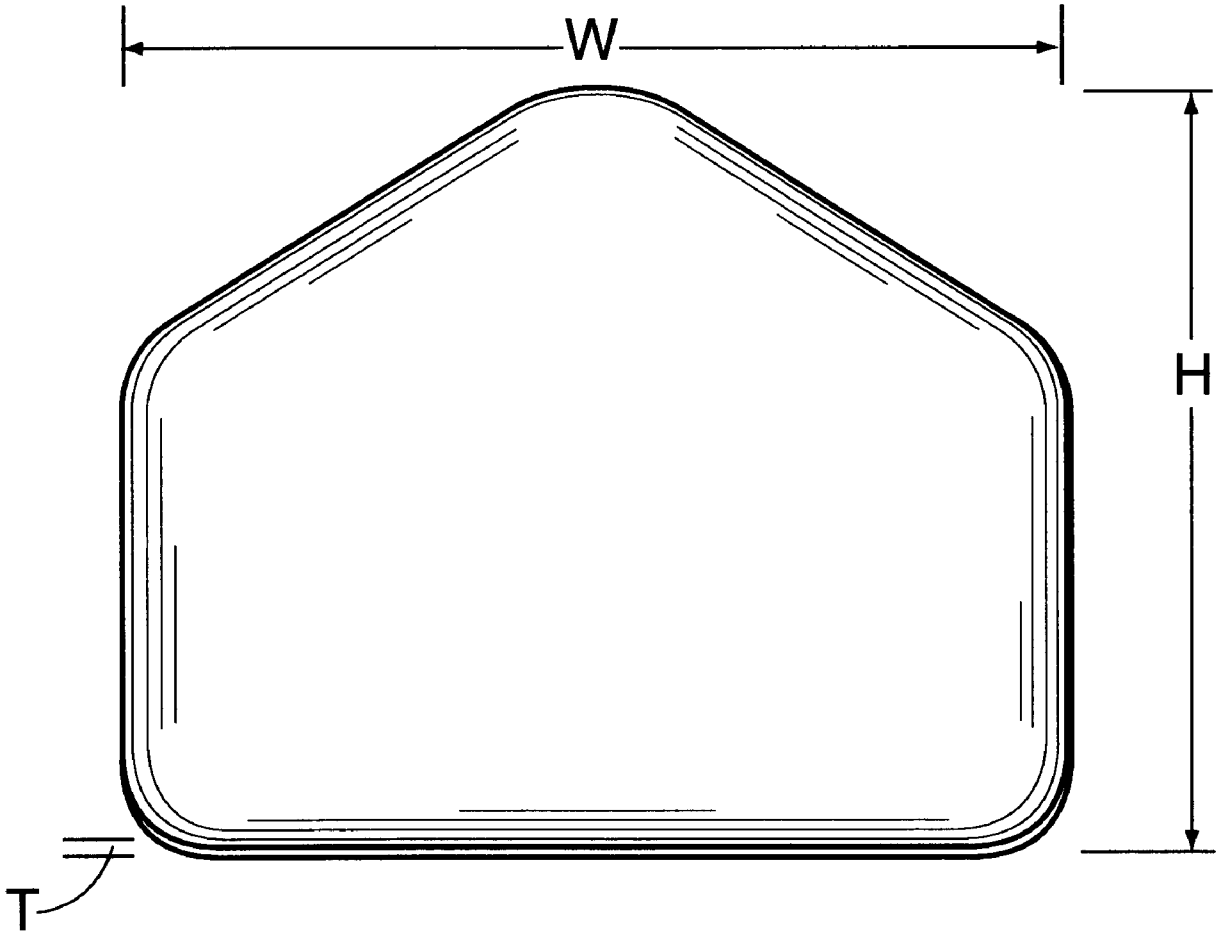
FIG. 7 shows the size of the plastic cap

FIG. 7. Size of plastic cap measuring:Which H=height:W=wide:T=thickness.H=4": W=5" wide: T=1/16" thick.

Figure 8:
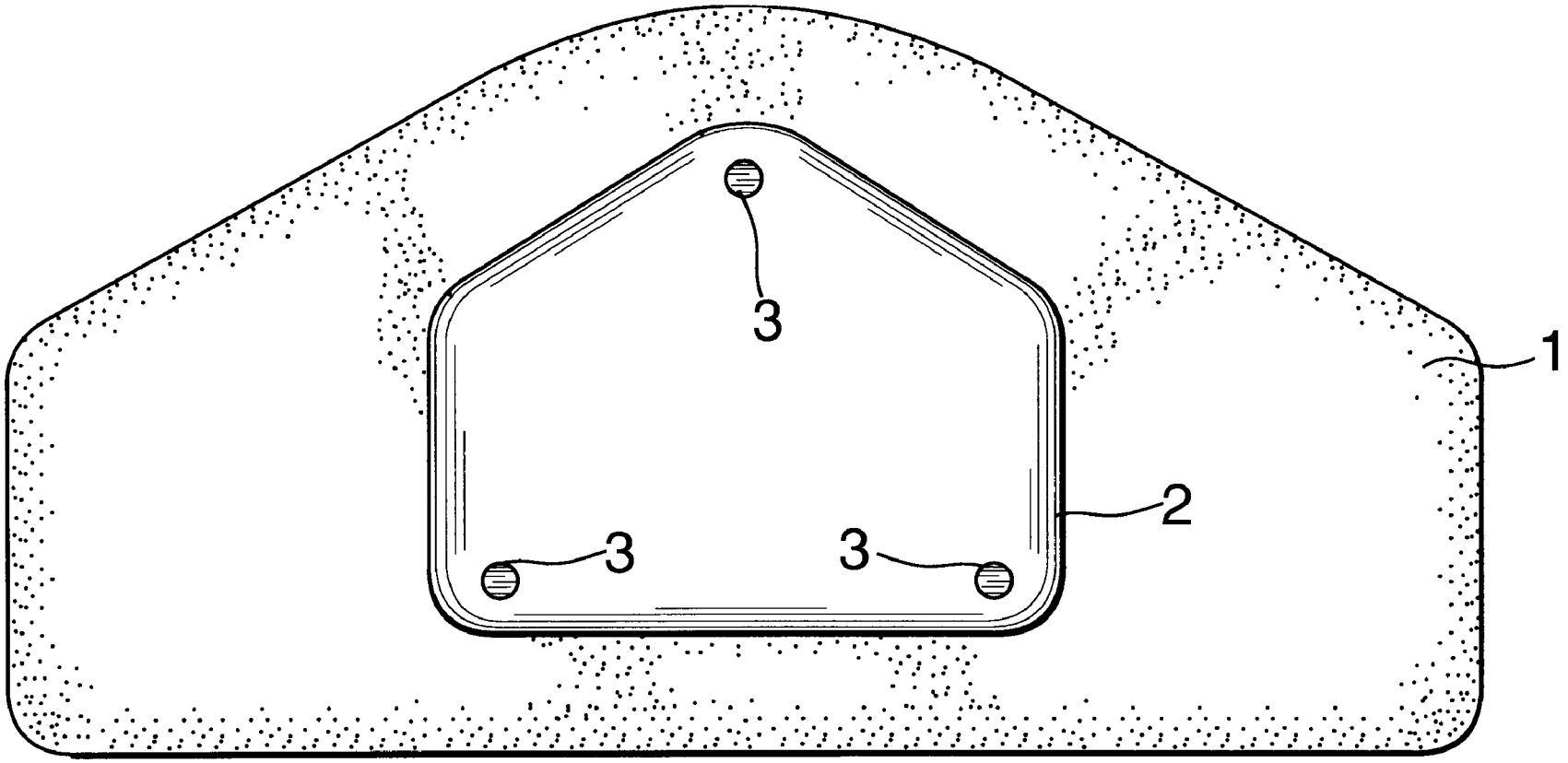
FIG. 8 shows the plastic attached to the pad by three rivits.

FIG. 8. Item #1:Material covering rubber pad.

FIG. 8. Item #2:plastic cap.

Item #3:rivets (3) three altogether,that attach the plastic to the material and to the rubber pad.

Figure 9:
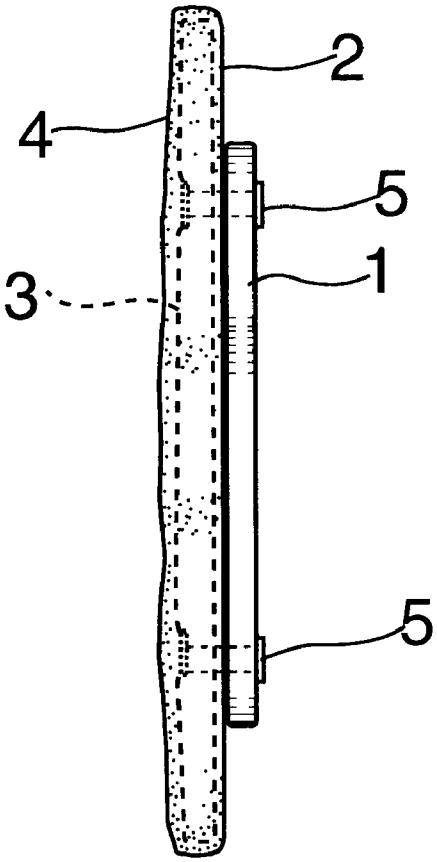
FIG. 9 shows the side view of the chest guard

FIG. 9. Side view of the chest guard.

Item #1:plastic cap

Item #2:Material

Item #3:rubber pad

Item #4:material used against body of player wearing chest guard.

Item #5:rivets, used to hold plastic and the material to the rubber pad.

Decription of Material used

1. Rubber Pad: 11"⅜" long by 5"⅝" high by ⅜" thick.
2. Soft Terry Cloth Material,(cover for pad,and protects the body)
3. Strong cotton stretch, (strong cotton for pads outside facing)
4. Snaps,(used to attach the straps to the chest protector.)
5. Elastic, (With adjustable buckle.)to go over shoulder and around the back of the player.
6. Plastic, (Caplike shape to cover over the middle of the pad.)4" high by 5" wide by 1/16" thick.
7. Rivets, (3 small pieces of metal used to attach the plastic and the material to the rubber pad.
8. Buckle: adjustable to attach to the elastic.

CONCLUSIONS, RAMIFICATIONS, AND SCOPE

Accordingly, it can be seen that I have provided a safe alternative for a ball player in the field. This chest guard provides safty to its wearer. Consumer Product Safty Commission reports 6 million children participate each year in organized leagues. Baseball leads in team sports in deaths to childern with three to four deaths each year. From 1973 to 1995 C.P.S.C. reports 88 baseball-related deaths to childern 0.68 or 77% from ball impact. 38 deaths or 56% to the chest. I have provided a means to cover and protect the heart area.

Although the description above contains many specificities, these should not be construed as limiting the scope of the Invention but as merely providing illustrations of some of the presently preferred embodiments of this invention. Various other embodiments and ramifications are possible within it's scope. For example, the Stealth Chest Guard,may be a benifit for most sports,including soccer,ice hockey,field hockey any sport which there is a danger of being struck in the chest area.

Thus the scope of the invention should be determined by the appended claims and their legal equivalents, rather than by the examples given.

What is claimed is:

1. A stealth chest guard which is lightweight, comfortable and flexible, the guard sized and shaped to cover the chest including the heart area, the guard comprising a light, firm rubber pad which measures ⅜ inches by 5⅝ inches by 11⅜ inches, a terry cloth material covering the rubber pad, plastic cover measuring 1/16 inches by 4 inches by 5 inches, the plastic cover attached to the rubber pad by three rivets and a plurality of straps for attaching the guard to a wearer.

* * * * *